United States Patent [19]

Manabe et al.

[11] 4,221,855

[45] Sep. 9, 1980

[54] ELECTROPHOTOGRAPHIC PLATE PRODUCED BY FIRING GLASS BINDER CONTAINING INORGANIC PHOTOCONDUCTOR AND HIGH MELTING POINT INORGANIC ADDITIVE IN NON-REDUCING ATMOSPHERE

[75] Inventors: Daisuke Manabe; Shuji Asai; Michihisa Suga, all of Tokyo, Japan

[73] Assignee: Nippon Electric Co., Ltd., Tokyo, Japan

[21] Appl. No.: 920,709

[22] Filed: Jun. 30, 1978

Related U.S. Application Data

[62] Division of Ser. No. 727,664, Sep. 29, 1976, abandoned.

[30] Foreign Application Priority Data

Oct. 2, 1975 [JP] Japan ..... 50-119246

[51] Int. Cl.[2] ..... G03G 5/04

[52] U.S. Cl. ..... 430/56; 430/84; 430/89; 430/96; 430/130; 106/54

[58] Field of Search ..... 252/501; 427/101, 74, 427/75; 96/1.8, 1.5; 106/54

[56] References Cited

U.S. PATENT DOCUMENTS

| | | | |
|---|---|---|---|
| 3,149,002 | 9/1964 | Place et al. | 427/101 |
| 3,288,604 | 11/1966 | Corrsin | 96/1.5 |
| 3,655,376 | 4/1972 | Wood et al. | 96/1.5 |
| 3,754,965 | 8/1973 | Mooney | 96/1 TE X |
| 3,837,906 | 9/1974 | Jones | 96/1.5 |

*Primary Examiner*—John D. Welsh

*Attorney, Agent, or Firm*—Hopgood, Calimafde, Kalil, Blaustein and Lieberman

[57] ABSTRACT

A sintered high sensitive electrophotographic plate free of cracks in a photoconductive layer and exfoliation of it from a substrate can be obtained by adding an inorganic material, whose melting or softening temperature is higher than a firing temperature, into a mixture composed essentially of photoconductive material and a glass binder having a softening temperature lower than the firing temperature.

7 Claims, No Drawings

ELECTROPHOTOGRAPHIC PLATE PRODUCED BY FIRING GLASS BINDER CONTAINING INORGANIC PHOTOCONDUCTOR AND HIGH MELTING POINT INORGANIC ADDITIVE IN NON-REDUCING ATMOSPHERE

This application is a division of U.S. application Ser. No. 727,664, filed Sept. 29, 1976, now abandoned.

The present invention relates to a method of producing a photoconductive layer for use in electrophotography.

The electrophotographic system resorting to a principle of transfer of electrostatic image (TESI) has been known, comprising an optically transparent electrode coated on an optically transparent substrate, a photoconductive layer formed on the transparent electrode, a second electrode facing at the photoconductive layer, and an insulative recording medium such as an electrostatic recording paper sandwiched between the photoconductive layer and the second electrode. By exposing the photoconductive layer to light and applying a pulse voltage across the transparent electrode and the second electrode, an electrostatic latent image is formed on the paper. The paper is removed from the photoconductive layer and the latent image is then made visible by applying charged toner particles on the paper.

A conventional electrophotographic plate is produced through the steps of mixing a photoconductive material, its solvent, activator, and lead sealing glass binder, applying the mixture to an optically transparent, electrically conductive substrate, drying it, and then firing it. During the firing there occurs concurrently diffusion of the activator into the photoconductive material, recrystallization of the photoconductive material, and melting of the glass binder particles. Such an electrophotographic plate is described in French Pat. No. 2,006,241, issued Dec. 26, 1969. This prior art electrophotographic plate, however, tends to give rise to cracks in the photoconductive layer and exfoliation of the photoconductive layer from the substrate, due to contraction of the photoconductive layer during the firing and due to difference in thermal expansion coefficient between the electrically conductive substrate, the photoconductive material and the glass binder.

One approach to reducing the strain due to contraction during the firing is proposed in U.S. Pat. No. 3,754,965 granted to J. B. Mooney in which firing is done in two steps; the first step is pre-firing for diffusing an activator into a photoconductive material and obtaining the activated photoconductor powder, and the second step is firing the activated photo-conductor powder mixed with lead sealing glass powder and suitable solvent and applied on an optically transparent, electrically conductive substrate. According to this approach, the strain due to contraction during the firing is considered to be reduced because the major contraction of the photoconductive material is observed in the pre-firing step. In practice, however, the strain due to difference in thermal expansion coefficients of the components occurs as in the case of one step of firing, with the result that cracks in the photoconductive layer and separation of it from the substrate still tend to be readily developed.

If a large amount of the lead sealing glass is used, it fills, upon melting, the interstitial spaces between the interlocked crystallites of the photoconductive matrix to serve as a binder. Accordingly, a photoconductive layer comprising a comparatively large amount of lead sealing glass has greater mechanical strength and fair stability against moisture and other atmospheric causes. However, its sensitivity is lowered to a degree impracticable in the electrophotography of TESI system, because the glass completely covers the surfaces of the photoconductor particles. Increasing the amount of the glass component will increase the difference in thermal expansion coefficient between the photoconductive material and the glass, readily causing cracks in the photoconductive layer and exfoliation of it from the substrate. After all, the amount of glass binder must be limited in order to realize a practical electrophotographic plate for the electrophotography of TESI system. While, a small amount of glass binder cannot fill the mentioned interstitial spaces and pores are formed there. As a result, these prior art photoconductive layers are porous in character and hence are readily affected by atmosphere, especially by moisture. Moreover, reducing the amount of glass will lead to decrease in the dark resistance, as well as in the breakdown voltage across the photoconductive layer. This has been a major cause of nonuniform recording and made it difficult to fabricate a practical photoconductive plate of high sensitivity.

One approach to filling the interstitial spaces and pores with the glass binder having a low softening temperature has been proposed in U.S. Pat. No. 3,745,504. However, in this prior art, firing must be done in two steps; the first step is firing the photoconductive material and an inorganic material such as a borosilicate glass having a high softening temperature to construct a sintered body having many interstitial spaces and pores, and the second step is firing the sintered body and the glass binder having a low softening temperature to fill the interstitial spaces and pores. The inorganic material must be transferred to the fused state so as to cover each of the crystals of the photoconductive material in the first step, and the temperature of the second step must be lower than that of the first step or the sintering temperature. Therefore, the photoconductive sensitivity becomes lower because of the surrounded fused state inorganic material.

It is therefore an object of the present invention to provide a method of producing a practical, high sensitive electrophotographic plate free of cracks in the photoconductive layer and exfoliation of it from the substrate.

It is another object of the invention to provide an improved method of producing a photoconductive layer with less porosity and thereby hardly affected by atmosphere.

Further object of the invention is to provide a method of producing an electrophotographic plate of which the mechanical strength is increased without sacrificing the sensitivity of the plate.

The present invention is based on the new finding that an electrophotographic plate free of cracks in the photoconductive layer and exfoliation of it from the substrate can be obtained by adding a powder of a solid inorganic, electrically nonconductive material, whose melting or softening temperature is higher than a predetermined temperature, to a conventional mixture of photoconductive material; its activator, its solvent, and a glass binder having a softening temperature below the predetermined temperature and by firing, or sintering, the resultant mixture at the predetermined temperature. As a result, the solid inorganic, electrically nonconductive material does not fuse during firing but retains the particle state and disperses within the fused glass binder along with the photoconductive material. In other words, the fused glass binder fills the interstitial spaces between the particles of the photoconductive material and the inorganic electrically nonconductive material. The photoconductive layer added with the mentioned inorganic material has a decreased porosity and an increased scratch hardness of about 20 to 50 times as much as that available with a photoconductive layer without the mentioned inorganic material.

In this specification, a firing temperature means a temperature at which the photoconductive material is dissolved with their solvent and the activator is diffused into the photoconductive material with the photoconductive material being sintered, the solvent being sublimated and the glass binder being fused. The firing temperature ranges normally from 500° C. to 700° C., more favorably from 550° C. to 650° C.

The present invention therefore provides a method of producing an electrophotographic plate which comprises the steps of preparing a mixture, in powdery form, of photoconductive material, a solvent for the photoconductive material, an activator suitable for promoting photoconductivity in the photoconductive material, a glass binder having a softening temperature below a selected firing temperature, and a solid inorganic, electrically nonconductive material having a melting or softening temperature above the firing temperature; preparing an optically transparent, electrically conductive substrate; applying the above mixture on to the substrate to form a layer thereof, and thereafter firing the layer at the firing temperature. It is favorable that in the starting mixture an amount of the glass binder ranges from about 1 to 50 parts, more favorably 3 to 40 parts, and that of the solid inorganic, electrically nonconductive material ranges from about 2 to 120 parts, more favorably 10 to 80 parts, both in volume per 100 parts in volume of the photoconductive material. It is preferable to represent the relation among the photoconductive material, the glass binder and the solid inorganic electrically nonconductive material by volume ratio rather than weight ratio. Here, the volume is calculated by dividing the weight by the density.

The present invention therefore provides an electrophotographic plate for transferring developable quantities of charge to an adjacent surface in response to photons incident upon the plate which comprises, an optically transparent electrically conductive substrate and a photoconductive layer disposed on this substrate and containing activated photoconductive elements, an electrically nonconductive glass binder softened and fused at the firing temperature and an inorganic electrically nonconductive, solid impregnant not softened nor fused during firing.

As the starting materials for the photoconductive layer, to which the inorganic material of the invention is to be added, those conventionally known in the art, such as described in U.S. Pat. No. 3,754,965, can be employed. In detail, the photoconductive material can be selected from the group consisting of sulfides, selenides, tellurides and sulphoselenides of a member of the group consisting of zinc and cadmium. As the activator for the photoconductive material, a halide of copper and/or silver can be used. By the firing process, copper and/or silver of the activator is introduced into zinc sulfide or other crystal of the photoconductive material as an impurity. A halide of cadmium or zinc is used as the solvent for the photoconductive material. It is considered that the solvent burns away and disappears from the photoconductive layer by the firing process. A glass binder having a softening temperature lower than the firing temperature, the one known as frit glass, or lead sealing glass, may be used, such as Corning's powdered glass 9776, 8463, 1417, 7570 and 1416. These glass materials are desirable when a glass substrate with a layer of a transparent electrode is used as the optically transparent conductive substrate. For an aluminum substrate, aluminum enamel frit AL80 or AL-9A made by Ferro Enamel Japan, Ltd., Osaka, Japan or like material is desirably used. It is preferable that the glass binder is added to the photoconductive material in an amount of 1 to 50 parts, favorably 3 to 40 parts, in volume per 100 parts in volume of the photoconductive material.

The inorganic electrically nonconductive material of the invention can be selected from the group of silicon dioxide, aluminum oxide, magnesium oxide, beryllium oxide, calcium oxide, cerium oxide, titanium oxide and a mixture of two or more of these materials. These materials have a melting or softening temperature higher than the firing temperature. Besides these, glass or like materials having a softening temperature higher than the firing temperature can be used as the mentioned inorganic material of the invention. It is preferable that an amount of this inorganic material to be added to the photoconductive material lies in a range of 2 to 120 parts, favorably 10 to 80 parts, in volume per 100 parts in volume of the photoconductive material.

The firing temperature of the mixture for photoconductive layer is normally 500° C. to 700° C., and favorably 550° C. to 650° C. During the firing process, the activator is diffused into the photoconductive material and a solvent is sublimated, while the glass binder is fused. On the other hand, the inorganic material remains in the particulated state and is dispersed over the fused glass binder. The firing step may be performed in two steps including the prefiring, as disclosed in U.S. Pat. No. 3,754,965.

The invention will be described in more detail by way of examples.

EXAMPLE 1

| | (weight) | (volume) | (volume ratio) |
|---|---|---|---|
| CdS (GE's No. 118-8-2) | 50g | 10.4 cc | 100 |
| $CuCl_2 2H_2O$ | 50 mg | 0.02 cc | 0.2 |
| $CdCl_2$ | 6 g | 1.48 cc | 14.3 |
| Lead glass (IWF7570 made by Iwaki Glass Co., Ltd., Tokyo, Japan, corresponding to Corning's No. 7570) | 1.5 g | 0.28 cc | 2.7 |
| Borosilicate glass (Corning's No. 7052) | 3 g | 1.32 cc | 12.7 |
| Ethyl alcohol | | 60 cc | |

These materials were crushed together in a ball mill for 30 hours. The role of ethyl alcohol is to make a fluid paste. The mixture was applied to a glass substrate (glass of Corning No. 7740) coated with tin oxide by the doctor blade method and then dried. The same was fired in a nitrogen atmosphere at 600° C. for 15 minutes whereby the lead glass was fused and copper was diffused into the cadmium sulfide microcrystals. The borosilicate glass powder remains in the particle form and is dispersed over the fused lead glass.

The sample was tested for recording in the TESI system under an exposure of 1 lux.sec. The recorded result was excellent.

In comparison with the above example, a typical prior art is shown below in which an inorganic material having a melting or softening temperature above the firing temperature is not used.

PRIOR ART EXAMPLE 1

| | (weight) | (volume) | (volume ratio) |
|---|---|---|---|
| CdS (GE's No. 118-8-2) | 50 g | 10.4 cc | 100 |
| $CuCl_2 . 2H_2O$ | 50 mg | 0.02 cc | 0.2 |
| $CdCl_2$ | 6 g | 1.48 cc | 14.3 |
| Lead glass (Iwaki's Glass IWF7570) | 10 g | 1.85 cc | 17.8 |
| Ethyl alcohol | | 60 cc | |

These materials were treated as in Example 1. The same was tested for recording in the TESI system. Recording was available under an exposure of 6 lux.sec. The recording was not uniform, probably due to partial lower breakdown voltage. A number of small cracks in the photoconductive layer were observed by an optical microscope. Also, some partial exfoliations were observed. Whereas, in the sample formed in Example 1, no cracks or exfoliation were observed. It was observed by a scanning type electron microscope that the photoconductive layer of the prior art sample is porous, while that of the invention has almost no pores and is dense. The two samples were subjected to recording test after they were placed in moisture at a humidity of 100% for 24 hours; the sample of the invention was found almost free of the moisture but the prior art sample exhibited a considerable amount of "fog" probably, because a large amount of moisture was absorbed by pores in the photoconductive layer and the dark resistance was considerably reduced. The samples were tested after they were subjected to heat atmosphere at a temperature of 100° C. for 5 hours; the sample of the invention exhibited good recording under the same exposure as applied before it was subjected to heat, but the prior art sample has to be exposed to a light energy of 9 lux.sec to obtain substantial recording. In short, the sample of the invention was virtually immune from atmospheric influences. Scratch hardness of the two samples were investigated by using a scratch hardness tester of continuous loading type. The sample of the invention was observed to have a scratch hardness of about 40 times as large as that of the prior art sample. This means that the photoconductive layer of the invention has far better durability than the conventional one.

EXAMPLE 2

A photoconductive layer was fabricated in the same manner as in Example 1, except silica powder was used instead of the borosilicate glass powder. The sample was observed to exhibit good photographic recording under an exposure of 1 lux.sec as in Example 1.

EXAMPLE 3

| | (weight) | (volume) | (volume ratio) |
|---|---|---|---|
| CdS (GE's No. 118-8-2) | 50 g | 10.4 cc | 100 |
| $CuCl_2 . 2H_2O$ | 50 mg | 0.02 cc | 0.2 |
| $CdCl_2$ | 6 g | 1.48 cc | 14.3 |
| Lead glass (Iwaki Glass's IWF7570) | 10 g | 1.85 cc | 17.8 |

-continued

| | (weight) | (volume) | (volume ratio) |
|---|---|---|---|
| Borosilicate glass (Corning's No. 7052) | 20 g | 8.77 cc | 84.6 |
| Ethyl alcohol | | 60 cc | |

These materials were mixed together and formed into a photoconductive layer as in Example 1. The sample was tested under an exposure of 6 lux.sec where an excellent recording was obtained.

There is a tendency that the sensitivity increases when the amount of glass binder having a softening temperature below the firing temperature and the amount of inorganic particles having a softening temperature above the firing temperature are small as in Examples 1 and 2; while the sensitivity decreases and the dark resistance increases, resulting in a picture of high contrast, when the amounts thereof are large as in Example 3.

As has been described above, the invention makes it possible to realize a highly useful, long-life, high sensitive electrophotographic plate with less porosity in a photoconductive layer and thus virtually free of atmospheric influences, as well as free of cracks and exfoliation.

In the foregoing examples, the photoconductive layers are obtained by a single firing process. Instead, two firing processes, i.e., preactivating firing step and a plate firing step, may be employed. In this case, needless to say, the inorganic, electrically nonconductive material is added prior to the second step. It is apparent that the photoconductive layer produced by the invention is readily applicable not only to the electrophotography of TESI system but to xerography, PIP system and other electrophotographic recording systems.

Thus while the invention has been herein described with respect to several of its examples, it is believed apparent that modification may be made therein without departing from the spirit and scope of the invention.

What is claimed is:

1. A method of producing an electrophotographic plate comprising the steps of forming a mixture, in powder form, of a photoconductive material, a solvent for said photoconductive material, an activator suitable for promoting photoconductivity in said photoconductive material, said photoconductive material being selected from the group consisting of sulphides, tellurides, selenides, and sulphoselenides of at least one of zinc and cadmium, a glass binder material having a softening temperature below a firing temperature ranging from about 500° C. to 700° C., and a solid inorganic electrically nonconductive material having a softening temperature higher than said firing temperature, said solid inorganic material being at least one selected from the group consisting of silicon dioxide, aluminum oxide, magnesium oxide, beryllium oxide, calcium oxide, cerium oxide, titanium oxide and borosilicate glass, applying said mixture on an optically transparent electrically conductive substrate, and firing said mixture under a nonreducing atmosphere at said firing temperature ranging from about 500° C. to 700° C., the temperature selected being higher than the softening temperature of said glass binder material and lower than the softening temperature of said inorganic material for a time sufficient for said glass binder to be fused to form a plate in which said solid inorganic material and said photoconductive material are dispersed within the fused glass binder.

2. The method of claim 1, in which said glass binder and said solid inorganic material in said mixture respectively range in amounts from about 1 to 50 parts and about 2 to 120 parts, in volume per 100 parts by volume of said photoconductive material.

3. The method of claim 1, in which said firing temperature falls within the range of 550° C. to 650° C.

4. The method of claim 1, in which amounts of said glass binder and solid inorganic, electrically nonconductive materials are within the ranges of 3 to 40 parts and 10 to 80 parts, respectively, each in volume per 100 parts by volume of said photoconductive material.

5. The method of claim 4, in which said photoconductive material consists essentially of cadmium sulphide and said solid inorganic material consists essentially of silicon dioxide, and in which said firing temperature ranges from 550° C. to 650° C.

6. An electrophotographic plate comprising an optically transparent electrically conductive substrate and a photoconductive layer formed on said substrate, said photoconductive layer being manufactured by a method comprising the steps of forming a mixture, in a powdery form, of a photoconductive material, a solvent for said photoconductive material, an activator suitable for promoting photoconductivity in said photoconductive material, said photoconductive material being selected from the group consisting of sulphides, tellurides, selenides, and sulphoselenides of at least one of zinc and cadmium, a glass binder having a softening temperature below a firing temperature ranging from about 500° C. to 700° C., and a solid inorganic electrically nonconductive material having a softening temperature higher than said firing temperature, said solid inorganic material being at least one selected from the group consisting of silicon dioxide, aluminum oxide, magnesium oxide, beryllium oxide, calcium oxide, cerium oxide, titanium oxide and borosilicate, said mixture containing, per 100 parts by volume of said photoconductive material, about 1 to 50 parts by volume of said glass binder and about 2 to 120 parts by volume of said solid inorganic material, applying said mixture on said optically transparent electrically conductive substrate, and firing said mixture at a temperature ranging from about 500° C. and 700° C. under a non-reducing atmosphere for a time sufficient for said glass binder material to be fused, said photoconductive layer including the fused glass binder, said solid inorganic material being of particle state and dispersing within said fused glass binder, and said photoconductive material dispersing within said fused glass binder, whereby said photoconductive layer is free of cracks and exfoliation from said substrate and is characterized by improved mechanical hardness and improved resistance to the atmosphere.

7. The method of claim 1, in which said non-reducing atmosphere is a nitrogen atmosphere.

* * * * *